US011191353B2

(12) United States Patent
Feeley et al.

(10) Patent No.: US 11,191,353 B2
(45) **Date of Patent: *Dec. 7, 2021**

(54) DROPPABLE KEYBOARD AND MOUSE PLATFORM

(71) Applicant: Ergodriven Inc., Cupertino, CA (US)

(72) Inventors: Ryan Feeley, Cupertino, CA (US); Christopher Perkins, Cupertino, CA (US)

(73) Assignee: Ergodriven, Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/659,412

(22) Filed: Oct. 21, 2019

(65) Prior Publication Data

US 2020/0113323 A1 Apr. 16, 2020

Related U.S. Application Data

(63) Continuation of application No. 14/876,814, filed on Oct. 6, 2015, now Pat. No. 10,448,733.
(Continued)

(51) Int. Cl.
*A47B 21/02* (2006.01)
*A47B 21/03* (2006.01)

(52) U.S. Cl.
CPC ..... *A47B 21/02* (2013.01); *A47B 21/0314* (2013.01); *A47B 2021/0357* (2013.01); *A47B 2200/0088* (2013.01)

(58) Field of Classification Search
CPC ..... A47B 21/02; A47B 21/04; A47B 21/0314; A47B 2021/0357; A47B 2200/0088
(Continued)

(56) References Cited

U.S. PATENT DOCUMENTS 458,959 A * 9/1891 Sanderson
484,136 A * 10/1892 Brown
(Continued)

FOREIGN PATENT DOCUMENTS

WO 1993008426 A1 4/1993

OTHER PUBLICATIONS

Non-Final Office Action received in U.S. Appl. No. 14/876,814, dated Sep. 12, 2016, 8 pages.
(Continued)

*Primary Examiner* — Daniel J Troy
*Assistant Examiner* — Timothy M Ayres
(74) *Attorney, Agent, or Firm* — Kilpatrick Townsend & Stockton LLP

(57) ABSTRACT

A desktop includes a first portion, a second portion, and a linkage assembly attached to the first and second portions. The first desktop portion has a first, substantially planar, upper surface, and an edge. The second desktop portion has a second, substantially planar, upper surface, a proximal edge, and a distal edge. The linkage assembly is configured such that the second desktop portion is movable between a first configuration and a second configuration. At the first configuration, the second desktop portion is substantially coplanar with the first desktop portion, and the proximal edge of the second desktop portion is adjacent the edge of the first desktop portion. At the second configuration, the proximal edge of the second desktop portion is beneath the edge of the first desktop portion, and the second desktop portion is not coplanar with the first desktop portion and is not parallel to the first desktop portion.

16 Claims, 7 Drawing Sheets

Related U.S. Application Data

(60) Provisional application No. 62/034,110, filed on Aug. 6, 2014.

(58) Field of Classification Search
USPC ..... 108/3, 6–10, 50.01
See application file for complete search history.

(56) References Cited

U.S. PATENT DOCUMENTS 536,706 A * 4/1895 Seiler
1,398,618 A * 11/1921 Albro ..... A47B 21/02 312/24
1,829,288 A 10/1931 May
1,940,046 A * 12/1933 Cutler ..... A47B 21/02 312/24
4,691,888 A 9/1987 Cotterill
4,735,466 A * 4/1988 Wolters ..... A47B 21/0314 248/694
5,048,784 A 9/1991 Schwartz
5,437,235 A 8/1995 Randolph
5,483,898 A 1/1996 Seidl
5,490,466 A 2/1996 Diffrient
5,526,756 A 6/1996 Watson
5,598,788 A * 2/1997 Jonker ..... A47B 9/10 108/147
5,646,819 A * 7/1997 Hill, III ..... A47B 21/0314 312/223.2
5,833,378 A 11/1998 Gibson
5,857,415 A 1/1999 Richard
5,961,231 A 10/1999 Ambrose
6,016,755 A 1/2000 Trapani
6,176,456 B1 1/2001 Wisniewski
6,273,382 B1 8/2001 Pemberton
7,013,813 B2 3/2006 Lima
7,100,516 B2 * 9/2006 Riddiford ..... A47B 21/00 108/50.01
7,707,946 B2 5/2010 Lima
8,061,278 B2 11/2011 Skiba
8,616,136 B2 12/2013 Burgess et al.
8,851,306 B2 * 10/2014 Spurr ..... A47B 46/005 211/117
9,486,070 B2 11/2016 Labrosse
10,448,733 B2 * 10/2019 Feeley ..... A47B 21/0314
2003/0230222 A1 12/2003 Liu
2009/0095868 A1 * 4/2009 Ohlson ..... A47B 21/02 248/371

OTHER PUBLICATIONS

Final Office Action received in U.S. Appl. No. 14/876,814, dated Mar. 7, 2017, 14 pages.
Non-Final Office Action received in U.S. Appl. No. 14/876,814, dated Jan. 24, 2018, 14 pages.
Notice of Allowance received in U.S. Appl. No. 14/876,814, dated Jun. 12, 2019, 5 pages.

* cited by examiner

DROPPABLE KEYBOARD AND MOUSE PLATFORM

CROSS-REFERENCES TO RELATED APPLICATIONS

This application is a continuation of Non-provisional application Ser. No. 14/876,814, filed Oct. 6, 2015 which claims priority to U.S. Provisional Application No. 62/034,110, filed Aug. 6, 2014, the disclosure of which is hereby incorporated by reference.

BACKGROUND OF THE INVENTION

Standing desks, and sit/stand convertible desks, are gaining in popularity. A standing desk typically provides a flat planar horizontal desktop at about the height of the user's sternum, or a few inches lower. A sit/stand convertible desk also provides a single flat planar horizontal desktop, but it can be raised and lowered between about sternum height, for use when standing, and a significantly lower height, for use when sitting.

These desks greatly increase the ease of moving the desktop between appropriate heights for sitting and standing. A computer monitor resting on the desktop also moves along with the desktop to be at eye level in both positions. However, if a keyboard and/or mouse also moves along with the desktop, the keyboard and mouse height is too high in the standing position, causing the user's shoulders to tighten in an awkward and ergonomically undesirable way.

Furthermore, the prior art contains keyboard and mouse trays, some of which are adjustable. However, these trays fail to allow ample vertical range of motion or full transition to flush with the primary desktop surface when the user is sitting. Beyond that, these trays are typically tilted toward the user (a positive angle), when research shows that this positive angle actually increases repetitive motion injuries, especially those in the wrist.

BRIEF SUMMARY

A desktop includes a first desktop portion, a second desktop portion, and a linkage assembly attached to the first and the second desktop portions. The first desktop portion has a first, substantially planar, upper surface, and an edge. The second desktop portion has a second, substantially planar, upper surface, a proximal edge, and a distal edge. The linkage assembly is configured such that the second desktop portion is movable between a first configuration and a second configuration. At the first configuration, the second desktop portion is substantially coplanar with the first desktop portion, and the proximal edge of the second desktop portion is adjacent the edge of the first desktop portion. At the second configuration, the proximal edge of the second desktop portion is beneath the edge of the first desktop portion, and the second desktop portion is not coplanar with the first desktop portion and is not parallel to the first desktop portion.

In the second configuration, the proximal edge of the second desktop portion may be beneath the edge of the first desktop portion and beneath the distal edge of the second desktop portion. In the second configuration, the second desktop portion may be angled at about 8° to about 30° with respect to the first desktop portion.

In the second configuration, the distal edge of the second desktop portion may be beneath the edge of the first desktop portion, and the proximal edge of the second desktop portion may be beneath both the edge of the first desktop portion and the distal edge of the second desktop portion.

The second desktop portion may be movable between the first configuration and the second configuration by a manual manipulation of a user without tools.

The linkage assembly may include a first link extending transverse from the first desktop portion; a second link pivotally attached to the first link and pivotally attached to the second desktop portion; a third link pivotally attached to the second desktop portion; and a fourth link extending transverse from the first desktop portion and pivotally attached to the third link.

The first link may include a stop that interferes with the second link when the second desktop portion is in the second configuration. This interference may act to maintain the second desktop portion in the second configuration.

In the first configuration, the third link may be oriented such that downward force on the second desktop portion maintains the second desktop portion in the first configuration.

The desktop may further include a lip. In the second configuration, the lip may present an upwardly extending surface transverse to the proximal edge of the second desktop portion.

The lip may be movable by the user, or may be automatically moved by the linkage assembly, such that the lip does not present the upwardly extending surface when the second desktop portion is in the first configuration.

Also disclosed is a desk which includes the above-described desktop, mounted on one or more legs, pillars, or posts.

BRIEF DESCRIPTION OF THE DRAWINGS

Exemplary embodiments will be described in more detail with reference to the accompanying drawings, in which:

FIG. 5A shows the configuration of FIGS. 1B and 4B;

FIG. 5B shows a configuration immediately prior to a snap;

FIGS. 5C, 5D, and 5E illustrate sequential improper configurations that may undesirably result if the snap were not to occur, for purposes of comparison; and FIGS. 5F, 5G, and 5H illustrate sequential proper configurations following the snap, where:

FIG. 5F shows a configuration immediately following the snap;

FIG. 5G shows a configuration immediately preceding a return to the home position; and FIG. 5H shows the home position of FIGS. 1A and 4A.

DETAILED DESCRIPTION OF EXEMPLARY EMBODIMENTS

Embodiments described herein provide a desktop which includes a main working surface and a platform for a keyboard and/or mouse, which platform is adjustable with respect to the main working surface. A bistable linkage assembly allows a user to move the platform between a home position, at which the platform is substantially horizontal and flush with the main working surface, and a dropped position, at which the platform is beneath the main working surface and tilted downward away from the user, with a simple, intuitive manual adjustment that does not require any tools or particular physical strength. The bistable linkage assembly also allows the platform to maintain both the home position and the dropped position without the need for latches, clamps, or fasteners.

Recent research shows that the ergonomically optimal angle for a keyboard and mouse is at a negative angle (i.e. with the end farthest from the user lower than the end closest to the user) of about 8° to 30°. This is true regardless of whether the user is sitting or standing, but many users find a negative platform angle when seated extremely awkward. The platform may rest on or dig into the user's thighs, and the position is unfamiliar. Therefore, many users prefer to have a flush, horizontal keyboard and mouse platform when seated.

Standing, however, provides additional clearance and a large range of motion that feels comfortable and natural. Therefore, for a sit/stand adjustable desk, it is extremely desirable to provide a keyboard and mouse platform that can move between two positions: flat and flush when the desktop is at the sitting height, and at a negative angle when the desktop is at the standing height.

Furthermore, some users may choose to have a unitary working surface for certain tasks, such as writing or sketching by hand with the keyboard and/or mouse set aside, and a keyboard and mouse platform with a negative angle for other tasks.

Figure 1A:
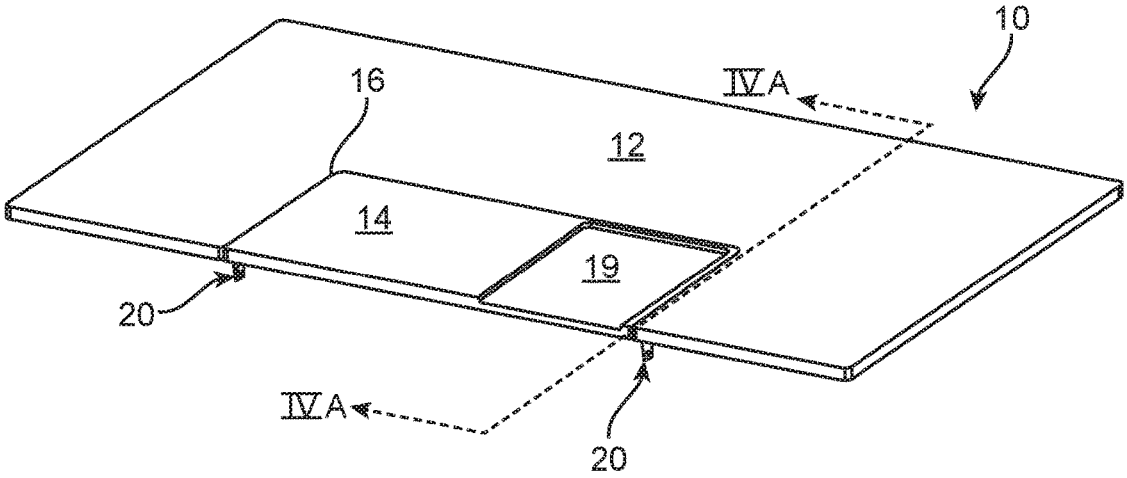
FIG. 1A is a perspective view of a desktop, with a platform thereof in the home position.
Figure 1B:
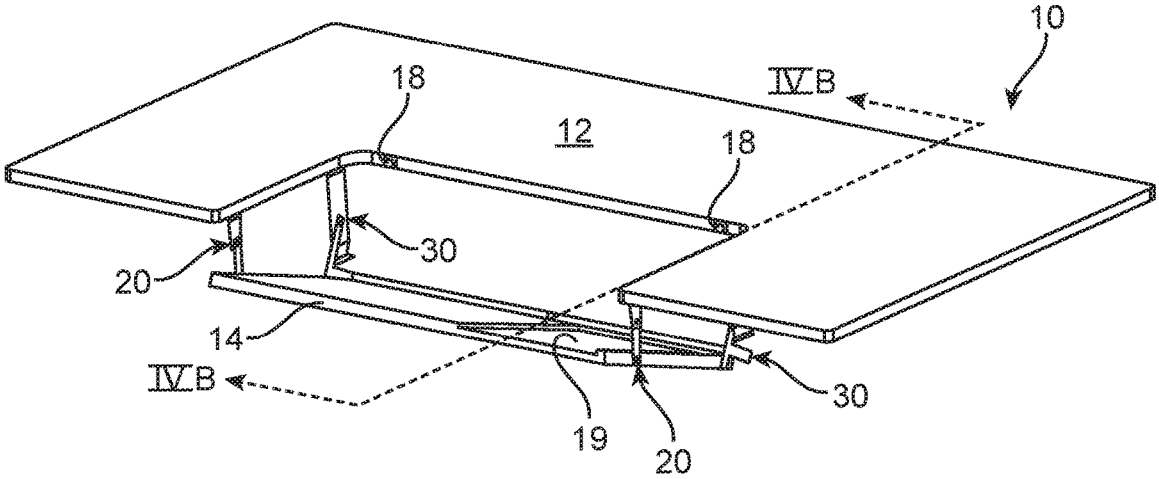
FIG. 1B is a perspective view of the desktop of FIG. 1A, with the platform in the dropped position.

Turning now to the Figures, with particular reference to FIGS. 1A and 1B, exemplary embodiments described herein provide a desktop 10 which includes a main working surface 12 and a platform 14 for a keyboard and/or mouse, which platform 14 is adjustable with respect to the main working surface 12. A bistable linkage assembly 20, 30 allows a user to move the platform between the horizontal position seen in FIG. 1A, at which the platform 14 is substantially horizontal, coplanar, and flush with the main working surface 12, presenting a small gap 16 on three sides of the platform 14, and the dropped position seen in FIG. 1B, at which the platform 14 is beneath the main working surface 12 and tilted downward away from the user.

The linkage assembly 20, 30 provides full support and produces the desired movement of the platform. A built-in hardstop 36 (FIG. 2) prevents the mechanism from moving too far, ensuring an optimal lowered position and orientation. The hardstop 36 and linkage assembly 20, 30 are both designed and positioned to provide firm resistance to deflection in a way that is tailored to the expected loads at each position. The exemplary embodiments can maintain each of the two bistable positions without separate latches: at the home position, the rear of the platform 14 abuts the front of the main working surface 12 (with small gap 16, of approximately 3/16"), and at the dropped position, the hardstop 36 blocks the platform 14 from moving any farther downward or rearward.

Figure 4A:
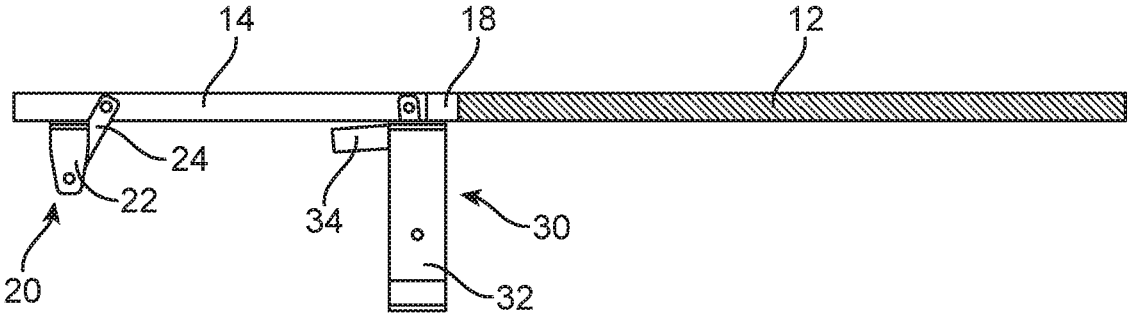
FIGS. 4A and 4B are elevational cross-sectional view taken along line IVA-IVA of FIG. 1A and line IVB-IVB of FIG. 1B, respectively.
Figure 4B:
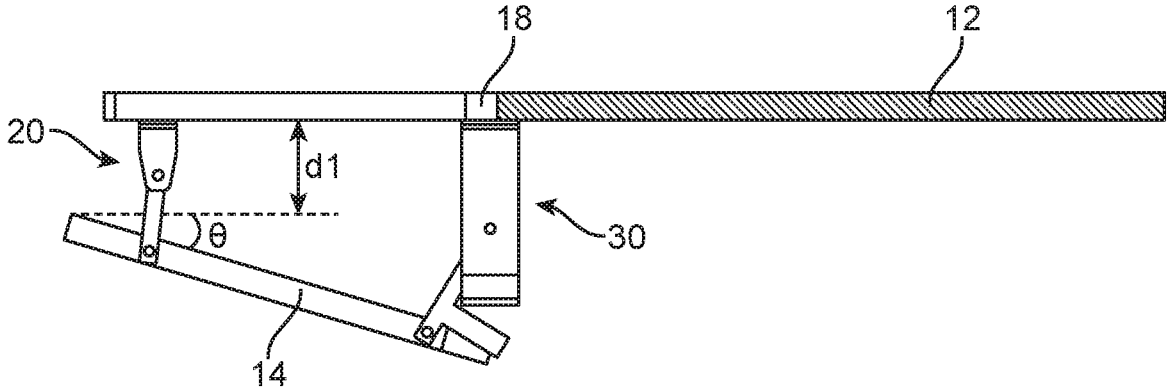

FIGS. 1B and 4B illustrate an ergonomically desirable position of the keyboard and mouse platform 14; lowered below the main working surface 12 at a distance $d_1$ (FIG. 4B) of approximately 4 inches and tilted away from the user, i.e. at a negative angle θ (FIG. 4B), of between about 8° and about 30°. Angles of more than about 20° may be so steep that a mouse may begin sliding when set still. Therefore, presently preferred angles are between about 8° and about 20°. The illustrated embodiment exhibits an angle of about 17.5°.

With reference to FIGS. 4A and 4B, the motion of the platform from the home position to the dropped position and back will now be described.

As seen in FIG. 4A, the platform 14 is in the home position, at which it is flush with the main working surface 12. The angle of the front link 24 is such that the platform's own weight and incidental bumps in the downward and/or rearward (i.e. toward the main working surface 12) directions are directed to keep the platform 14 in place, so it is not moved to the dropped position accidentally. Soft adhesive-backed bumpers 18 may prevent the platform 14 and main working surface 12 from scratching or dinging one another when the platform 14 is subject to such bumps.

To move the platform 14 to the dropped position of FIG. 4B, first the user gives a slight upward and forward pull to the platform. This motion is rather intuitive and soon becomes second-nature. After the slight upward and forward pull, the user swings the platform downward, then downward and rearward. The linkages 20, 30 guide the platform through its full range of motion until it arrives at the position seen in FIG. 4B, at which the interference of the link 34 with the hardstop 36 of the link 32 blocks the platform 14 from moving any farther (see also FIG. 2).

To move the platform back, the user pulls up and toward him- or herself, and the platform begins reversing its movement.

Figure 5A:
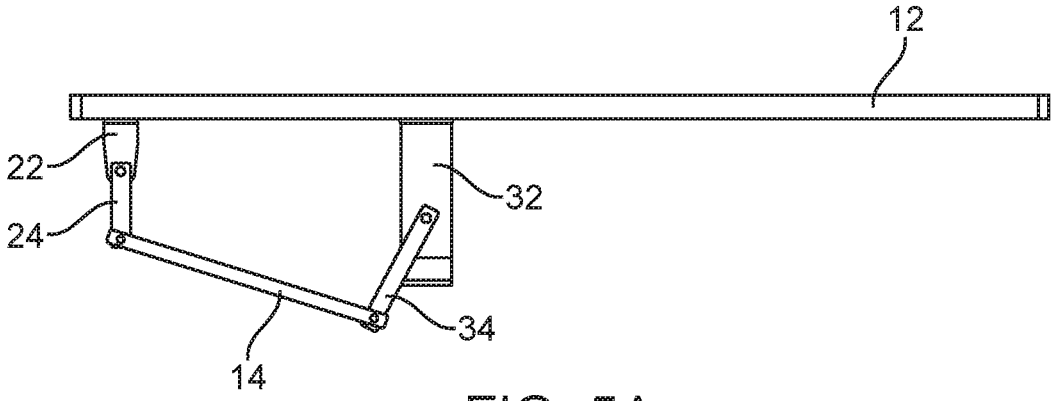
FIGS. 5A-5H are side elevational views of the exemplary desktop in various configurations, where.
Figure 5B:
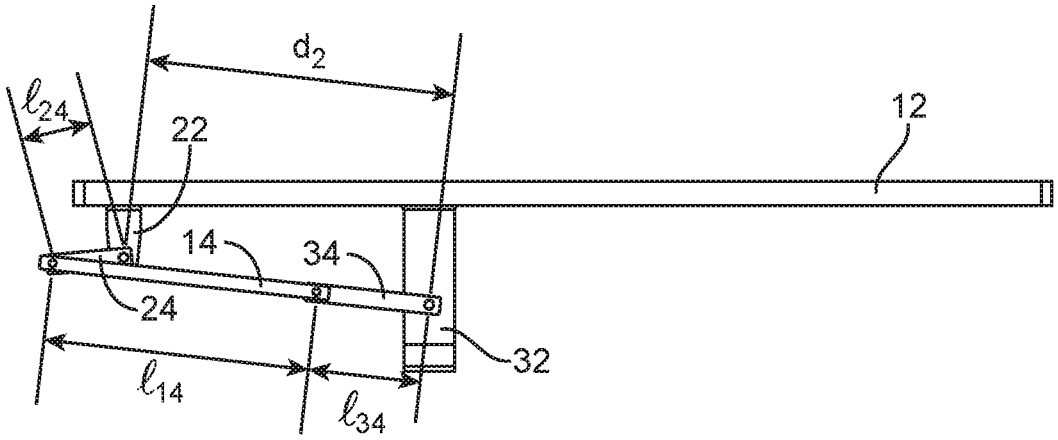

It will be appreciated that, in the point in the platform 14's travel at which the links 24, 34 are approximately collinear with each other and with the platform 14, the linkage system presents enough degrees of freedom that the platform 14 may assume positions and orientations other than that which will lead it back smoothly to the home position. For example, in one undesirable scenario, starting from the fully dropped position seen in FIG. 5A, the user pulls the platform 14 to the position seen in FIG. 5B, at which the links 24, 34 are approximately collinear with each other and with the platform 14. If the link 34 were to swing back downwards rather than continuing its upward travel at this point, while the user continued to pull upwards on the front edge of the platform 14, the orientation seen in FIG. 5C would result, followed by the orientation seen in FIG. 5D and ultimately that of FIG. 5E. This configuration would clearly be useless, and may likely result in keyboard, mouse, and mouse pad falling off the back of the platform 14.

Therefore, turning back to FIG. 5B, in a presently preferred embodiment, the length $l_{34}$ of the rear link 34, the length $l_{14}$ of the platform 14, the length $l_{24}$ of the link 24, and the distance $d_2$ between the hinge points on the links 22 and 32, are selected such that $l_{34}+l_{14}-l_{24}$ is very slightly smaller than $d_2$ ($l_{34}+l_{14}-l_{24}<d_2$). This relationship provides a slight resistance at the configuration seen in FIG. 5B, which the user must pull ever so slightly harder to overcome. (This increased pulling force is rather intuitive, and becomes second-nature to the user after a few uses.) Since the force on the link 32 is farther from the connection point of the link 32 to the main working surface 12 than that of the link 22, and since the user is typically pulling from the front edge of the platform 14, very near the link 22, the increased pulling force of the user torques the link 32 more than the other components and acts to bend the link 32 ever so slightly forward, and then immediately back, until the platform 14 and linkages 20, 30 snap into the configuration seen in FIG. 5F. The snap is aided by tolerances and clearance in the pivot points joining the links 32 and 34, the link 34 to the platform 14, the platform 14 to the link 24, and the links 24 and 22. After this "snap," the upward pulling force will pull the platform 14 into the configuration seen in FIG. 5G and finally the home position, seen in FIG. 5H, avoiding the undesirable configurations of FIGS. 5C, 5D, and 5E. Exemplary lengths are as follows:

$l_{34}$=3.500"
$l_{14}$=8.875"
$l_{24}$=2.125"
$d_2$=10.310"

$$l_{34}+l_{14}-l_{24}=10.250''<d_2=10.310''$$

Thus, it will be seen that this particular exemplary embodiment provides 0.060" of interference, providing for the above-described snap.

Figure 5C:
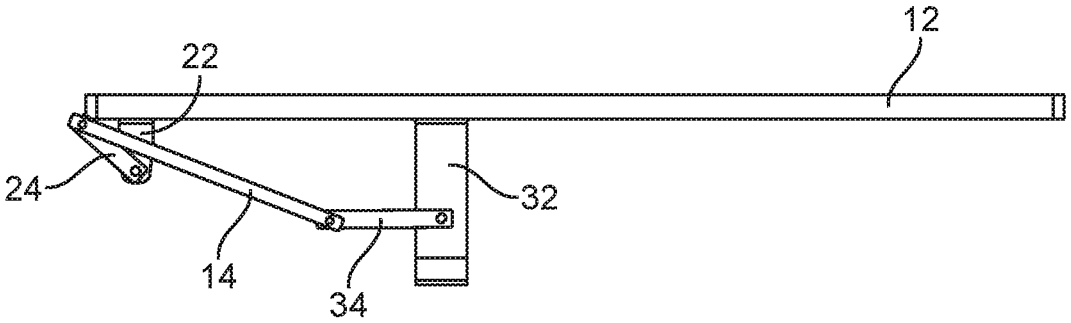
Figure 5D:
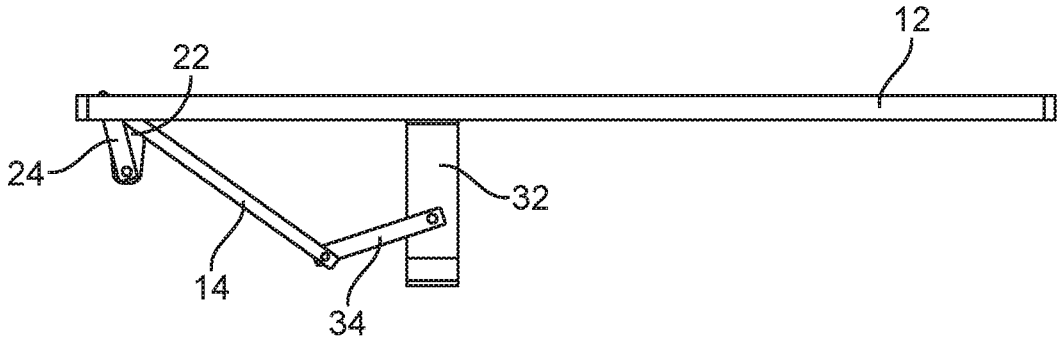
Figure 5E:
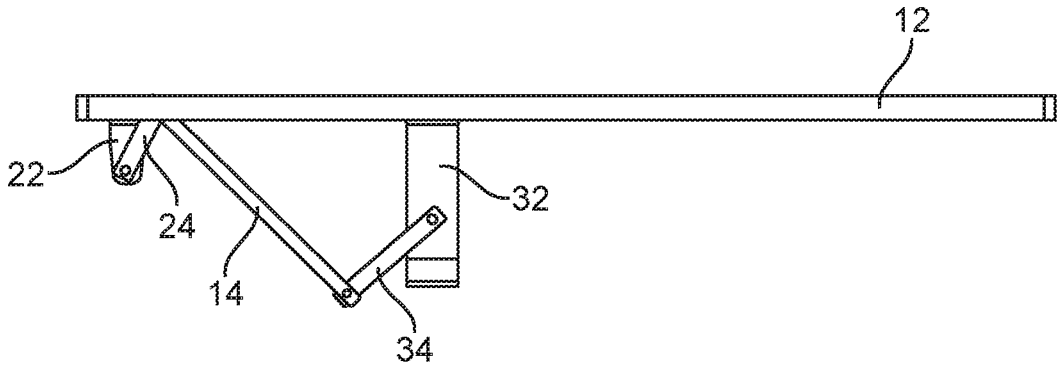
Figure 5F:
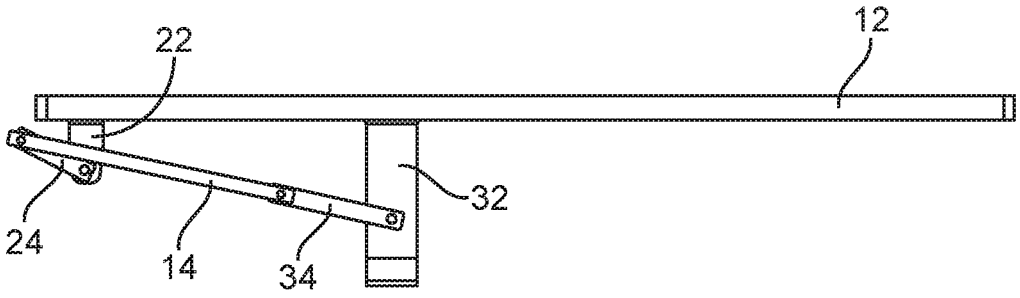
Figure 5G:
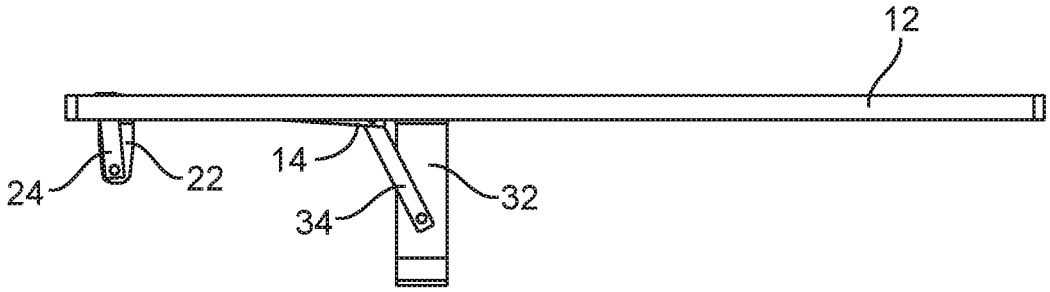
Figure 5H:
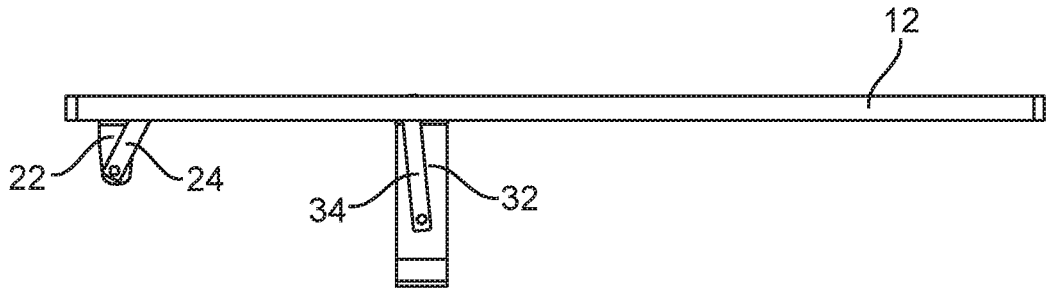

It will be appreciated that when lowering the platform 14 in the reverse order, the motion of the platform 14 is aided by gravity, so no undesirable configurations such as those seen in FIGS. 5C, 5D, and 5E are likely to occur.

Turning back to FIGS. 1A-1B, some embodiments include a recessed mouse pad area 19 which keeps the mouse pad from sliding backward past its desired position. Most keyboards include high-friction rubber feet, and therefore, in some embodiments, no corresponding recess needs to be provided for the keyboard.

Figure 2:
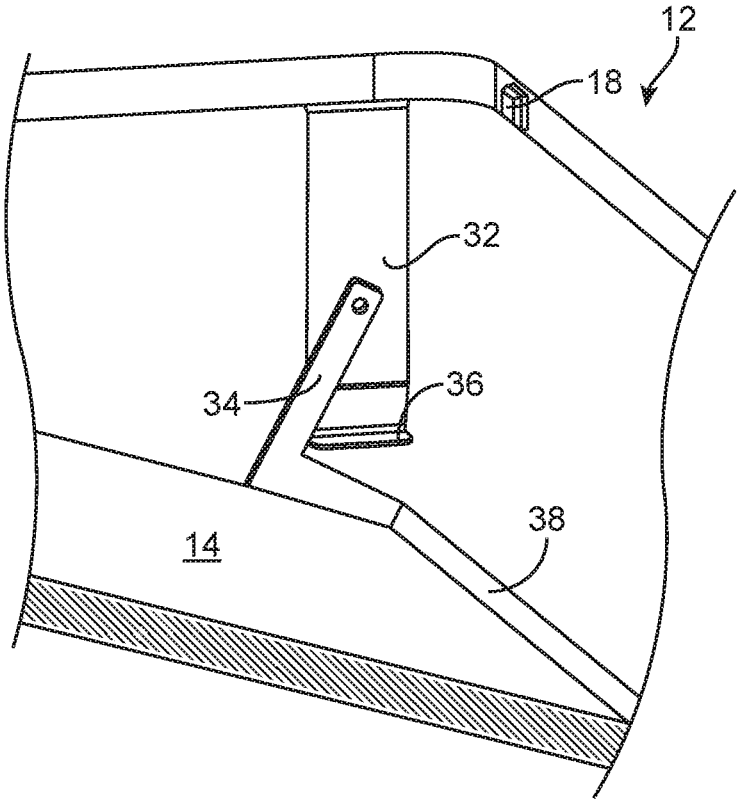
FIG. 2 is an expanded view of the desktop in the configuration of FIG. 1B, partly in cross-section.
Figure 3:
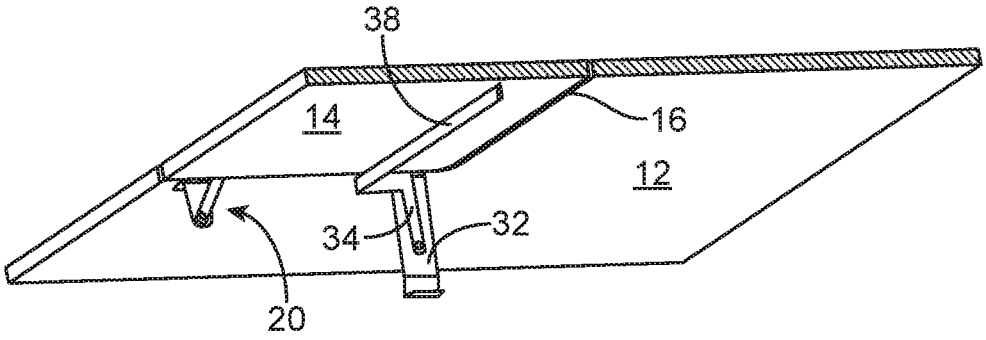
FIG. 3 is an expanded view of the desktop in the configuration of FIG. 1A, partly in cross-section.

Some embodiments include a lip 38 integrated with one or both of the links 34, which may keep mouse, keyboard, and small items like pens from sliding or rolling off the back of the platform 14 when the platform 14 is in the dropped position. Turning to FIGS. 2 and 3, in some embodiments, the lip 38 automatically swings out of the way when the platform 14 is moved to the horizontal home position (FIG. 3), so the platform 14 cooperates with the main working surface 12 to provide a unitary working surface free of the lip 38 (whose presence may inconvenience the user). When the platform 14 is swung back down to the dropped position, the lip 38 may automatically swing back up (FIG. 2) to keep items from sliding off the back of the platform 14.

Other embodiments of the lip are possible. For example, a lip may be fixed to the platform 14 or the main working surface 12. Still further, a lip may be separately slidable or pivotable into and out of position by a separate manipulation of the user, rather than being integrated with the motion of the linkage assembly 20, 30.

Figure 6:
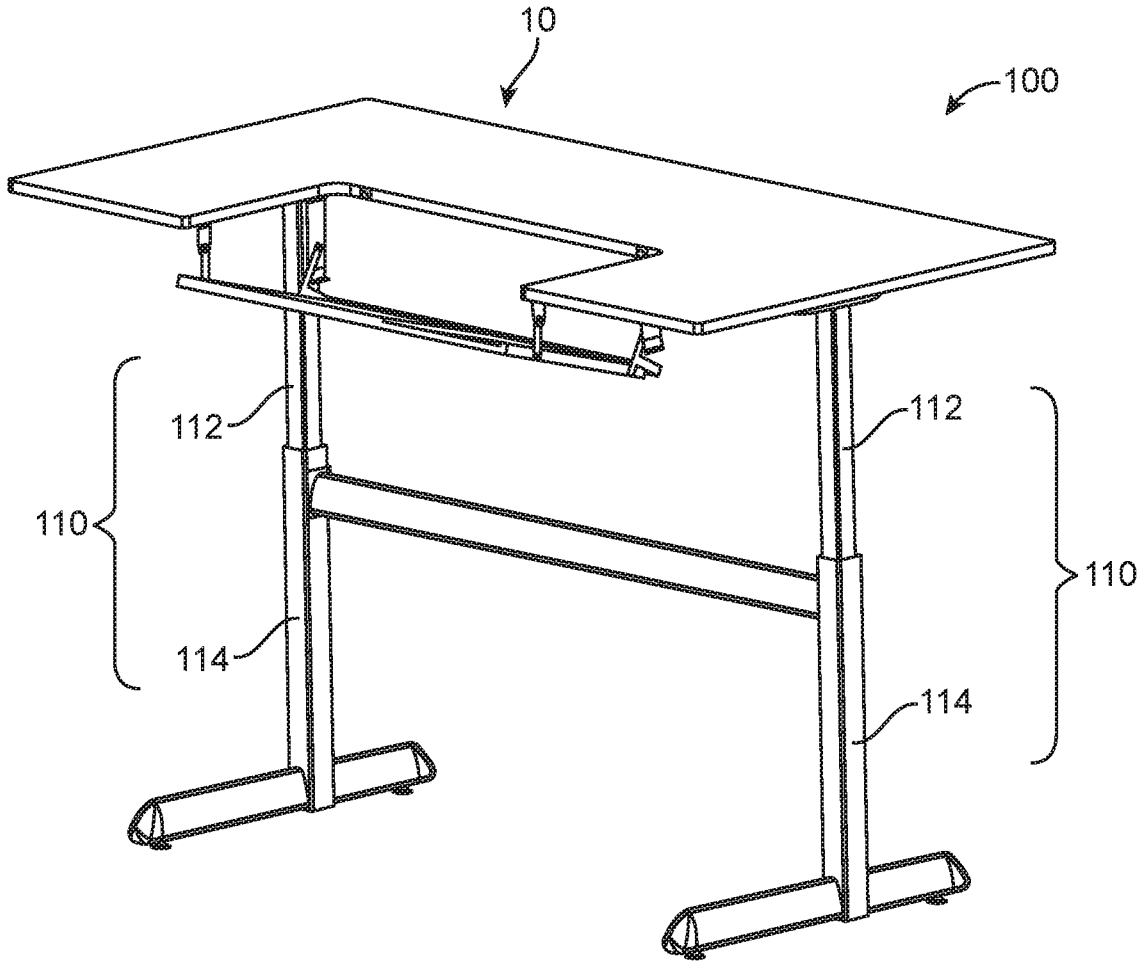
FIG. 6 illustrates the exemplary desktop integrated in a desk, in the configuration of FIGS. 1B and 4B.

In a presently preferred embodiment, the desktop 10 is provided merely as a desktop, i.e. as a modular component of a desk, to later be attached to legs or posts to define a completed desk. This installation can be done by a retailer or by the end user. Thus, retailers that offer optional features and modular components can easily integrate the exemplary desktop into any configuration a user desires, such as a sitting desk, a standing desk, or a sit/stand convertible desk. The latter of these, a sit/stand convertible desk 100, is shown in FIG. 6. The top portions 112 of the legs 110 can be slid into and out of the bottom portions 114 of the legs to allow for a continuously variable adjustable-height desktop 10.

However, the present invention is not limited to such a modular form. The above-described desktop 10 may be integrated into a completed desk 100 of any fixed or adjustable height. It is also contemplated that the linkage assembly 20, 30 may be sold on its own, as a kit, to allow a retailer or end user to modify an existing desktop into one with a droppable platform 14, such as by cutting an existing monolithic desktop into two pieces 12, 14, and attaching the linkages 20, 30.

As will be understood by those skilled in the art, the present invention may be embodied in other specific forms without departing from the essential characteristics thereof. Many other embodiments are possible without departing from the essential characteristics thereof. Many other embodiments are possible without deviating from the spirit and scope of the invention. These other embodiments are intended to be included within the scope of the present invention, which is set forth in the following claims.

What is claimed is:

1. A desktop of a desk, comprising:

a first desktop portion defining a first surface, wherein the first surface is substantially planar;

a second desktop portion defining a second surface, wherein the second surface is substantially planar; and a plurality of links coupling the first desktop portion to the second desktop portion;

wherein the first desktop portion, the second desktop portion, and the plurality of links define a linkage, wherein the linkage is configured to transition through a range of motion from a first stable configuration to a second stable configuration, wherein in the first stable configuration the second surface is positioned at a first height relative to the first surface and a first angle relative to the first surface, wherein in the second stable configuration the second surface is positioned at a second height, different than the first height, relative to the first surface and a second angle relative to the first surface, wherein the linkage does not define additional stable configurations in the range of motion from the first stable configuration to the second stable configuration, wherein the linkage is configured to maintain the first stable configuration and transition from the first stable configuration without securing or releasing any latches, clamps, or fasteners, wherein the linkage is configured to maintain the second stable configuration and transition to the second stable configuration without securing or releasing any latches, clamps, or fasteners, and wherein the linkage is configured to transition from the second stable configuration to the first stable configuration without fastening or unfastening any fasteners by initially moving the second desktop portion upwardly and horizontally away from the first desktop portion and subsequently moving the second desktop portion downwardly and horizontally toward the first desktop portion.

2. A desktop of a desk, comprising:

a first desktop portion defining a first surface, wherein the first surface is substantially planar;

a second desktop portion defining a second surface, wherein the second surface is substantially planar; and a plurality of links coupling the first desktop portion to the second desktop portion;

wherein the first desktop portion, the second desktop portion, and the plurality of links define a linkage, wherein the linkage is configured to transition through a range of motion from a first stable configuration to a second stable configuration, wherein in the first stable configuration the second surface is positioned at a first height relative to the first surface and a first angle relative to the first surface, wherein in the second stable configuration the second surface is positioned at a second height, different than the first height, relative to the first surface and a second angle relative to the first surface, wherein the linkage does not define additional stable configurations in the range of motion from the first stable configuration to the second stable configuration, wherein the linkage is configured to maintain the first stable configuration and transition from the first stable configuration without securing or releasing any latches, clamps, or fasteners, wherein the linkage is configured to maintain the second stable configuration and transition to the second stable configuration without securing or releasing any latches, clamps, or fasteners, and wherein the plurality of links comprise:

a first link fixedly coupled to extending downwardly from the first desktop portion;

a second link pivotally attached to the first link and pivotally attached to the second desktop portion;

a third link pivotally attached to the second desktop portion; and a fourth link fixedly coupled to and extending downwardly from the first desktop portion and pivotally attached to the third link.

3. The desktop of claim 2, wherein the second link comprises a lip, wherein in the second stable configuration the lip extends upwardly from a rear edge of the second surface.

4. The desktop of claim 3, wherein in the first stable configuration the lip does not extend upwardly from the rear edge of the second surface so that the first surface and the second surface define a continuous work surface.

5. The desktop of claim 2, wherein the first link comprises a stop configured to contact the second link in order to define the second stable configuration in the range of motion.

6. A desktop of a desk, comprising:

a first desktop portion defining a first surface, wherein the first surface is substantially planar;

a second desktop portion defining a second surface, wherein the second surface is substantially planar; and a plurality of links coupling the first desktop portion to the second desktop portion;

wherein the first desktop portion, the second desktop portion, and the plurality of links define a linkage, wherein the linkage is configured to transition through a range of motion from a first stable configuration to a second stable configuration, wherein in the first stable configuration the second surface is positioned at a first height relative to the first surface and a first angle relative to the first surface, wherein in the second stable configuration the second surface is positioned at a second height, different than the first height, relative to the first surface and a second angle relative to the first surface, wherein the linkage does not define additional stable configurations in the range of motion from the first stable configuration to the second stable configuration, wherein the linkage is configured to maintain the first stable configuration and transition from the first stable configuration without securing or releasing any latches, clamps, or fasteners, wherein the linkage is configured to maintain the second stable configuration and transition to the second stable configuration without securing or releasing any latches, clamps, or fasteners, and wherein the linkage is configured to transition from the first stable configuration to the second stable configuration without fastening or unfastening any fasteners by initially moving the second desktop portion upwardly and horizontally away from the first desktop portion and subsequently moving the second desktop portion downwardly and horizontally toward the first desktop portion.

7. The desktop of claim 6, wherein in the first stable configuration the first surface and the second surface are coplanar to define a continuous work surface.

8. The desktop of claim 7, wherein in the second stable configuration the second surface is below the first surface and the second surface is obliquely angled so that a rear edge of the second surface is below a front edge of the second surface.

9. The desktop of claim 8, wherein in the second stable configuration the second surface is obliquely angled between 8° and 30°.

10. The desktop of claim 8, wherein the first desktop portion defines a three sided rectangular cutout, and wherein in the first stable configuration the second desktop portion is positioned within the three sided rectangular cutout.

11. The desktop of claim 10, wherein the linkage comprises a lip, wherein in the second stable configuration the lip extends upwardly from the rear edge of the second surface.

12. The desktop of claim 11, wherein in the first stable configuration the lip does not extend upwardly from the rear edge of the second surface so that the first surface and the second surface define the continuous work surface.

13. The desktop of claim 12, wherein the linkage is configured so that the lip automatically transitions between extending upwardly from the rear edge of the second surface in the second stable configuration and not extending upwardly from the rear edge of the second surface in the first stable configuration.

14. The desktop of claim 6, wherein, with the first surface fixed in a horizontal orientation, in the first stable configuration the second surface is in a horizontal configuration and in the second stable configuration the second surface is in an oblique orientation relative to horizontal.

15. The desktop of claim 14, further comprising:

one or more legs or pillars configured to be set on a floor, wherein the one or more legs or pillars are adjustable in height in order to maintain the first surface in a horizontal orientation at a plurality of different height configurations.

16. The desktop of claim 15, wherein the plurality of different height configurations comprise a first height configuration with the one or more legs or pillars set at a sitting height, and a second height configuration with the one or more legs or pillars set at a standing height higher than the sitting height, and wherein the desk is configured to be in the first stable configuration at the sitting height and the second stable configuration at the standing height.

* * * * *